US007300221B2

(12) United States Patent
Byun

(10) Patent No.: US 7,300,221 B2
(45) Date of Patent: Nov. 27, 2007

(54) COSMETIC CASE

(76) Inventor: Young-Kwang Byun, 928-1005, Mok-dong Apt, 312, Shinjeong-dong, Yangcheon-ku, Seoul 158-769 (KR)

( * ) Notice: Subject to any disclaimer, the term of this patent is extended or adjusted under 35 U.S.C. 154(b) by 0 days.

(21) Appl. No.: 11/528,426

(22) Filed: Sep. 28, 2006

(65) Prior Publication Data

US 2007/0081851 A1 Apr. 12, 2007

(30) Foreign Application Priority Data

Oct. 11, 2005 (KR) ..... 10-2005-0095350

(51) Int. Cl.
*A46B 11/04* (2006.01)
*B43K 5/06* (2006.01)

(52) U.S. Cl. ..... 401/286; 401/277; 401/175

(58) Field of Classification Search ..... 401/270, 401/277, 275, 282, 286, 175, 172
See application file for complete search history.

(56) References Cited

U.S. PATENT DOCUMENTS 1,943,893 A * 1/1934 Johnson ..... 401/175
4,071,300 A * 1/1978 Nichols et al. ..... 401/175

* cited by examiner

*Primary Examiner*—David J. Walczak
(74) *Attorney, Agent, or Firm*—Birch, Stewart, Kolasch & Birch, LLP

(57) ABSTRACT

A cosmetics case comprising a cosmetics case having a lower body of the case is turns, and a piston in which is applied in inner portion of the lower body is moved lower to press the inside, with aligned to a screw rod by the turning of the lower body of the container, and thus, a check valve of which installed in upper inside hall which formed upper portion of inside of the screw rod, is pressed open then, opened a through hole, therefore, the liquid cosmetics which stored inside of the lower body is passed through a perpendicular hole, a through hole, an upper inside hole and an liquid transfer tube which formed an ejecting hole, then ejecting the liquid to a brush portion with a determined quantity of the cosmetics;

The lower body is stops turning, concurrently with; to lower pressure of the inside of the lower body, and the check valve returned to the origin state by the spring power of the spring which installed inside of the upper inside hole and, close off the through hole, therefore the cosmetics can not ejecting out more; thus can easily control the ejecting and close off the cosmetics liquid.

1 Claim, 6 Drawing Sheets

COSMETIC CASE

CROSS-REFERENCE TO RELATED APPLICATIONS

This application claims the benefit of Korean Patent Application No. 10-2005-0095350, filed on Oct. 11, 2005, in the Korean Intellectual Property Office, the disclose of which is incorporated herein by reference.

BACKGROUND

1. Field of the Invention

The present invention relates to a cosmetics case of an ejecting or squeeze type liquid cosmetics such as a foundation or lipstick, and more particularly, to a cosmetics case having a lower body of the container which turns, and a piston in an inner portion of the lower body which is moved lower to press the cosmetics inside. The piston is aligned with a screw rod and moved by the turning of the lower body of the container.

A check valve is installed in an upper inside hall which is formed at an upper portion of the inside of the screw rod. The valve is pressed to open a through hole, through which the liquid cosmetics stored inside the lower body is passed.

A through hole, an upper inside hole and a liquid transfer tube form an ejecting hole, which ejects the liquid to a brush portion with a determined quantity of the cosmetics.

When the lower body stops turning, the pressure of the inside of the lower body is reduced, and the check valve returns to its original state by the spring power of the spring which is installed inside the upper inside hole. The through hole is then closed, so that the cosmetics can not eject any more. Thus one can easily control the ejecting and stopping of the cosmetics liquid.

2. Discussion of Related Art

Various cosmetics cases have been used to satisfy demands that they should be compact and convenient for use, have an attractive appearance, and be such as to allow the cosmetics contained therein to be easily handled.

Typically, cosmetics are solid, powder or in the liquid state. Currently, liquid cosmetics of foundation or lipstick are applied at the convenience of the user. The liquid cosmetics are filled in a pencil type circular container, so that the cosmetics are ejected to the upper portion of brush part of the inside of the case by pressing the inside of the case when a part of the container is pressed by the user.

Hereinafter, a conventional cosmetics case will be described in detail with reference to the drawings.

An ejecting type liquid cosmetics case of the prior art, is disclosed in FIG. 6 and FIG. 7.

The container includes a case body 101 which receives liquid cosmetics, a brush 102 which is used to apply the cosmetics and a cap 108 for protecting the brush 102. The case body 101 includes a rod 104 which has a piston 103 that pushes the liquid cosmetics to the brush 102, and a nut element 105*a* which is joined to the rod 104 with a screw joint, is fixed to the wall of the body 101 and supports the moving of the rod 104. The moving body 105 has a one direction turning guide element 105*b* attached to the nut element 105*a* and a rod movement cap 106 which surrounds the rod 104.

In the cosmetics case of the above mentioned prior art, the piston 103 which is jointed to the head end of the rod 104, is insertingly joined in the coupling portion 104*a*. Therefore the moving of the piston 103 is severe from the rod 104, and is easily separated by a small impact. An end of the spring 107 which applies repulsive power to a rod moving cap 106 is inserted to the rear end of the rod 104.

When, the rod moving cap 106 is rotated, an end of the spring 107 interferes with the rod moving cap 106, causing a noise and making the revolution of the rod moving cap 106 not go smoothly.

And since the moving body 105 has a one direction turning guide element 105*b* attached to the nut element 105*a* which can rotate in one direction only, returning is not possible, so that one can not prevent the flow of the cosmetics when there is a small impact or if it is positioned reversely. Therefore, there are many disadvantages, and it is complicated in construction and costs much.

SUMMARY OF THE INVENTION

Accordingly, it is an object of the present invention to provide a reasonable cosmetics case to which is convenient to use and commercially useful.

In order to achieve the foregoing and/or other objects of the present invention, according to the present invention, there is provided a cosmetics case having a lower body 10 of the container which turns, and a piston in an inner portion of the lower body which is moved lower to press the cosmetics inside. The piston is aligned with a screw rod and moved by the turning of the lower case body.

A check valve is installed in an upper inside hall which is formed at an upper portion of inside of the screw rod. The valve is pressed open to open a through hole 32 through which the liquid cosmetics 3 stored inside of the lower body is passed. A perpendicular hole 33, a though hole 32, an upper inside hole and an liquid transfer tube form an ejecting hole, which eject the liquid to a brush portion 50 with a determined quantity of the cosmetics.

When the lower body stops turning, the pressure of the inside of the lower body is reduced, and the check valve returns to its original state by the spring power of the spring which is installed inside the upper inside hole. The through hole 32 is then closed so that the cosmetics can not eject any more. Thus it can easily control the ejecting and stopping of the cosmetics liquid.

BRIEF DESCRIPTION OF THE DRAWINGS

These and/or other objects and advantages of the invention will become apparent and more readily appreciated from the following description of the preferred embodiments, taken in conjunction with the accompanying drawings of which.

DETAILED DESCRIPTION OF PREFERRED EMBODIMENTS

Figure 1:
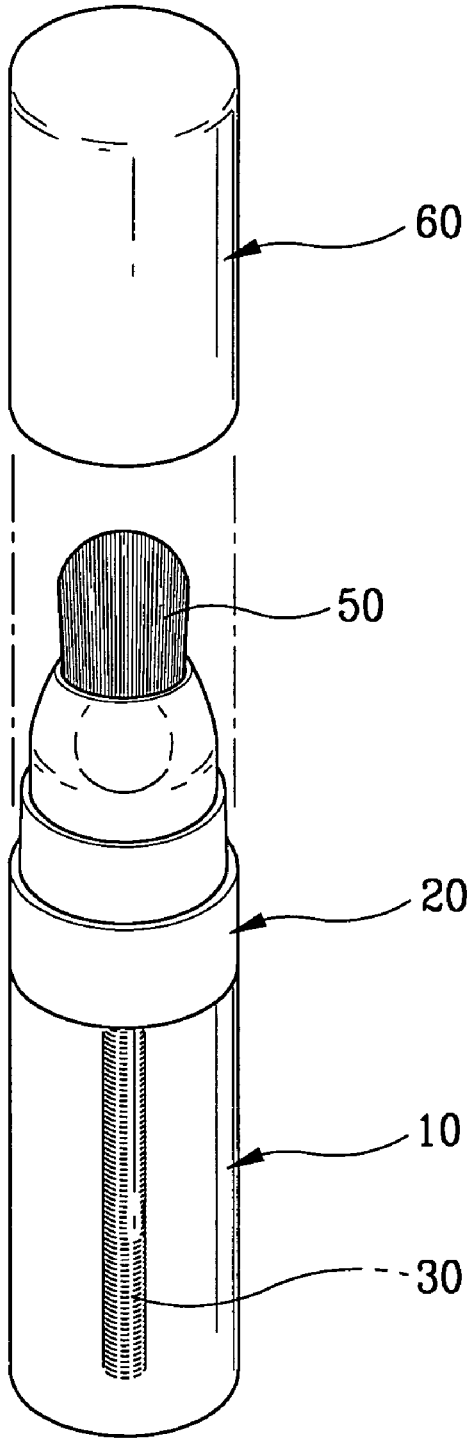
FIG. 1 is a schematic perspective view in accordance with one embodiment of the present invention.

Hereinafter, a preferred embodiment of the present invention will be described with reference to the attached drawings.

As illustrated in FIG. 1-FIG. 5, a cosmetics case has a lower body 10. A piston 36 which is in an inner portion of the lower body, moves downwardly to press the cosmetics inside. The piston is aligned with a screw rod 30 and moved the turning of the lower body 10 of the container. A check valve 31*a* is installed in an upper inside hall 31 which is formed on the upper portion of inside of the screw rod 30. The valve is opened to open a through hole 32, through which the liquid cosmetics 3 stored inside the lower body 10 is passed. A perpendicular hole 33, a through hole 32, an upper inside hole 31 and an liquid transfer tube 41 form an ejecting hole 40, which then eject the liquid to a brush portion 50 with a determined quantity of the cosmetics.

When the lower body 10 stops turning, the pressure of the inside of the lower body 10 is lowered.

The check valve 31*a* returns to its original state by the spring power of the spring 31*b* which is installed inside the upper inside hole 31. The through hole 32, is then closed so that the cosmetics 3 can not eject any more.

Thus, one can easily control the ejection and in stopping of the cosmetics liquid by the opening and shutting of the through hole 32 by the check valve 31*a,* while the piston 36 moves downwardly aligned with the screw rod 30 and moved with the rotation of the lower body 10.

Figure 2:
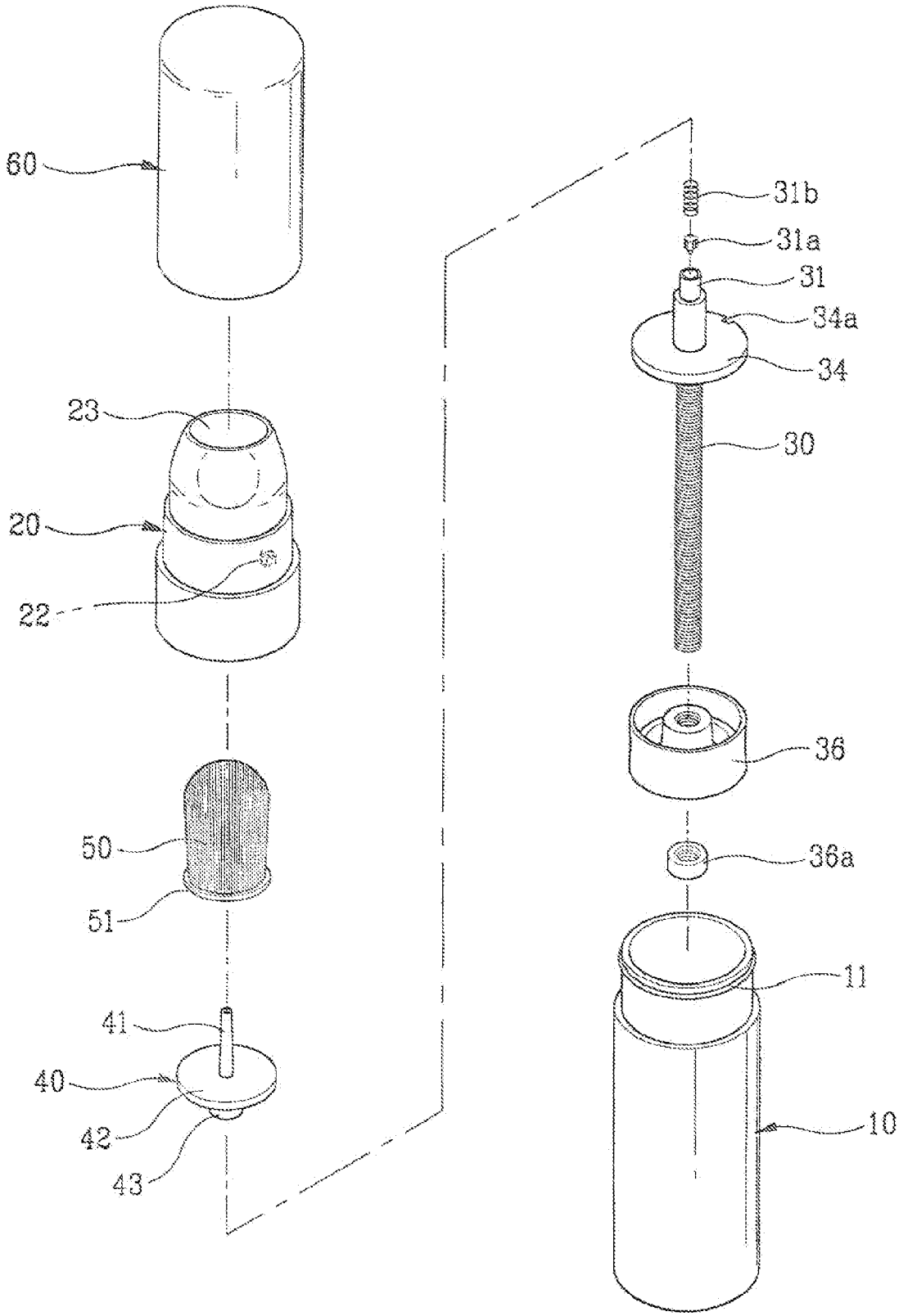
FIG. 2 is a separated perspective view in accordance with one embodiment of the present invention.
Figure 3:
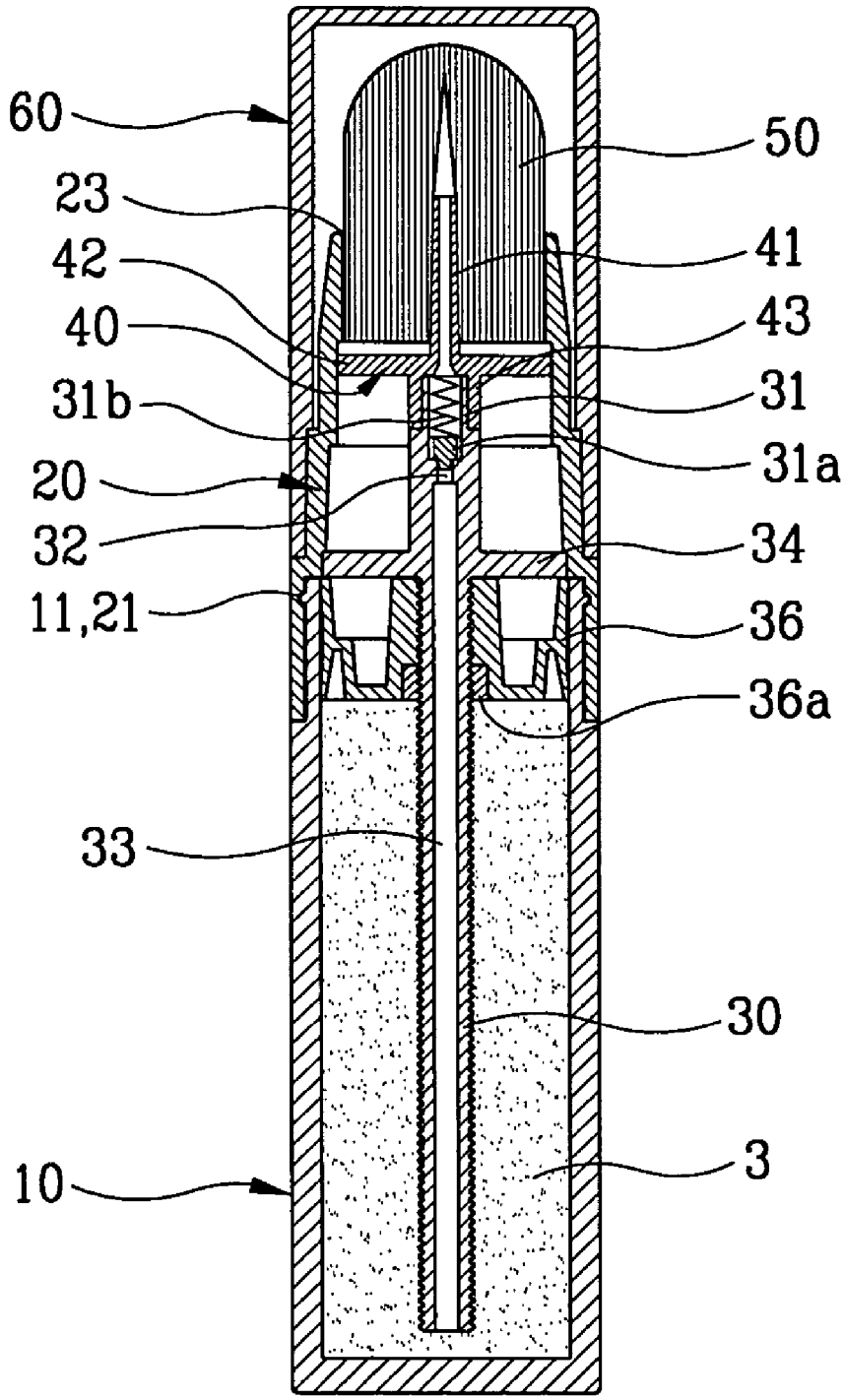
FIG. 3 is a combined cross sectional view in accordance with one embodiment of the present invention.
Figure 4:
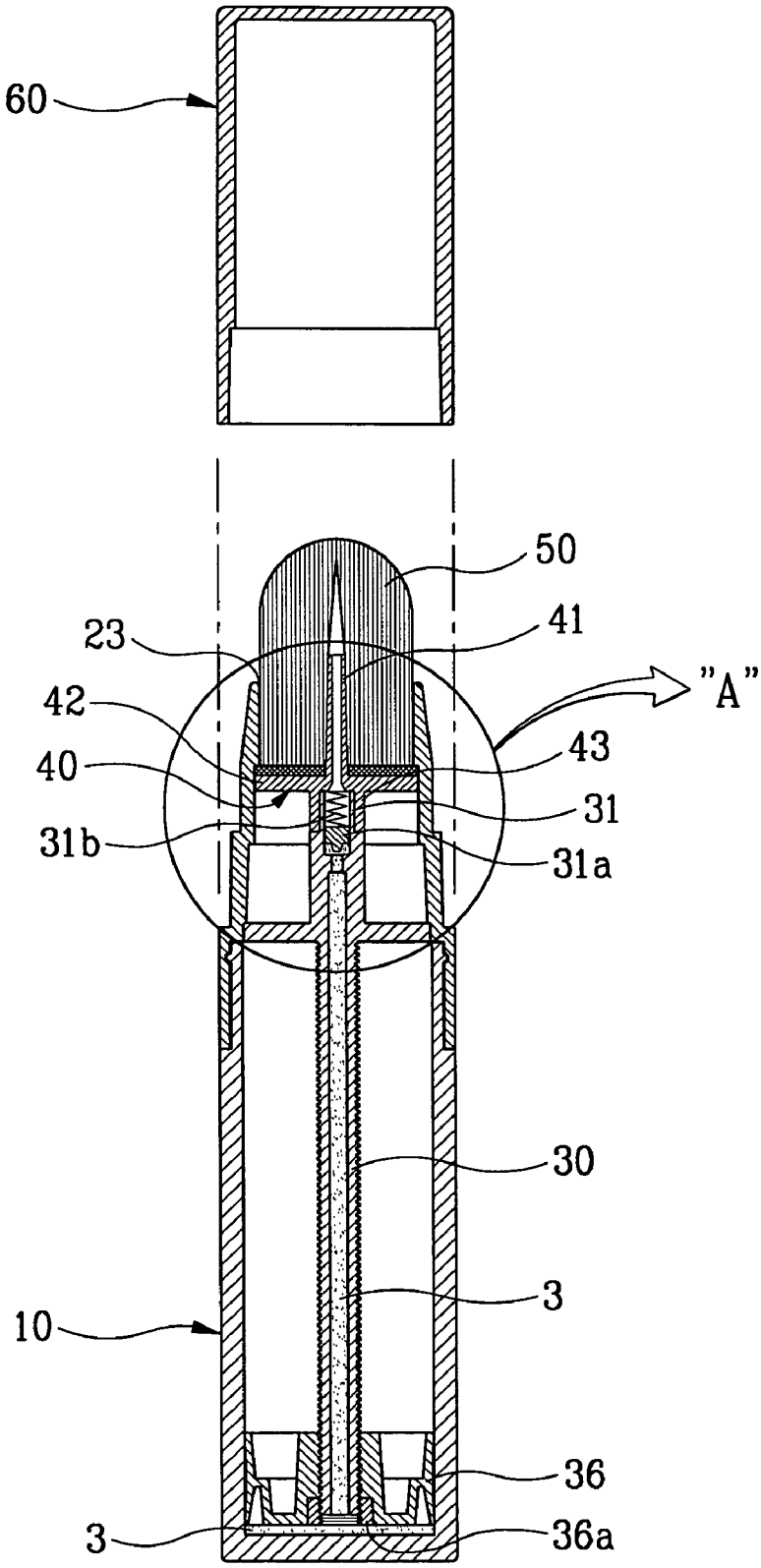
FIG. 4 is an use state view in accordance with one embodiment of the present invention, it shows stored cosmetics in the lower body are vanishing completely by the piston go down.
Figure 5:
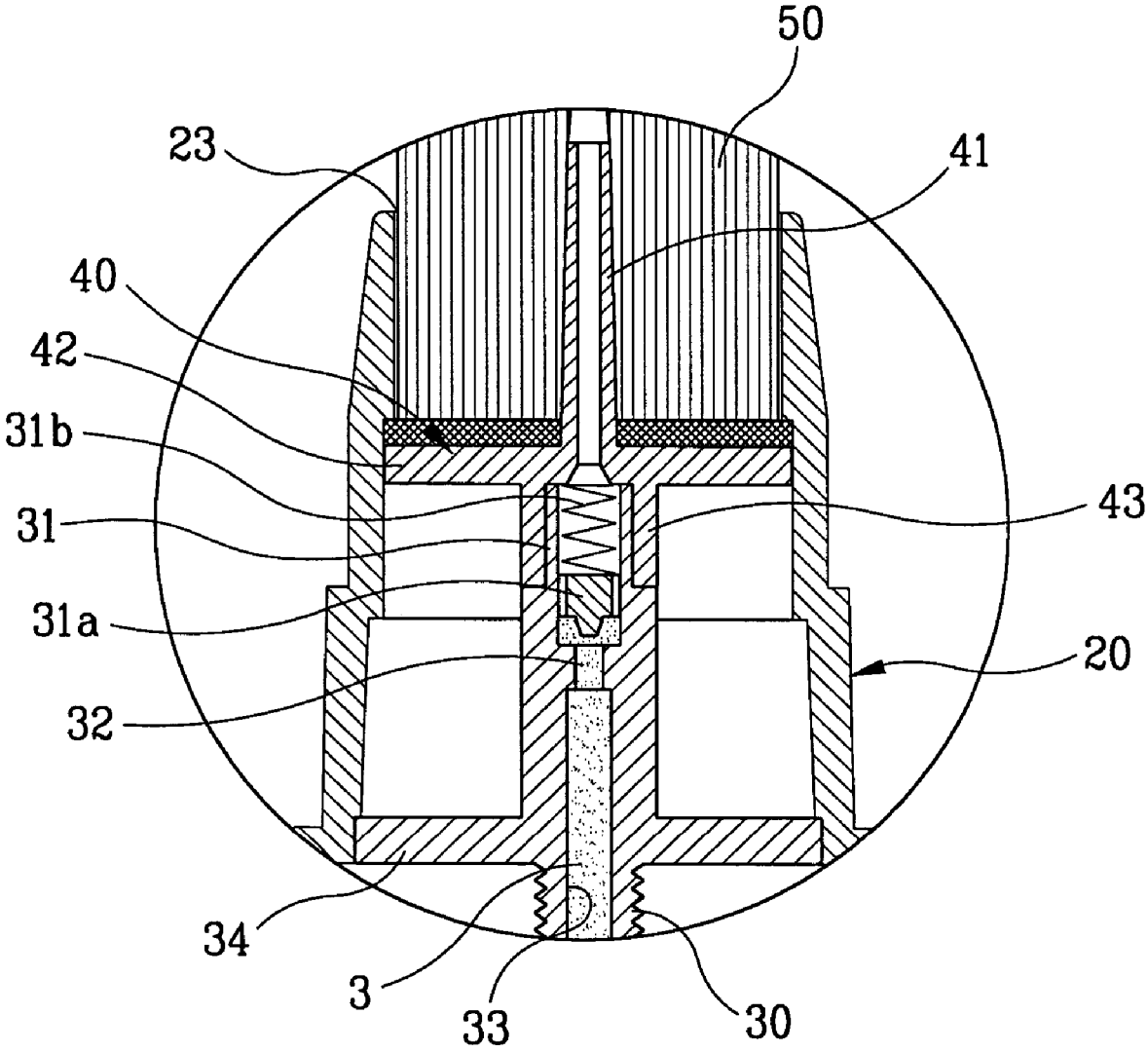
FIG. 5 is an enlarged cross sectional view of portion A of FIG. 4.
Figure 6:
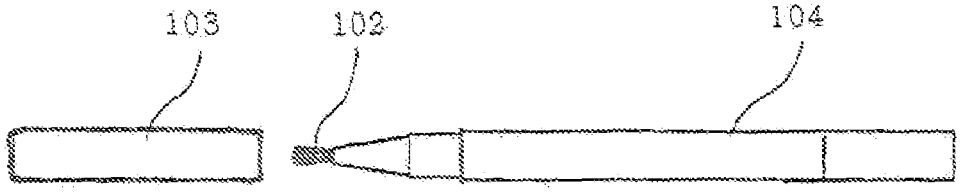
FIG. 6 PRIOR ART
FIG. 6 is a front view of a case of a conventional ejecting type liquid cosmetics in prior art.
Figure 7:
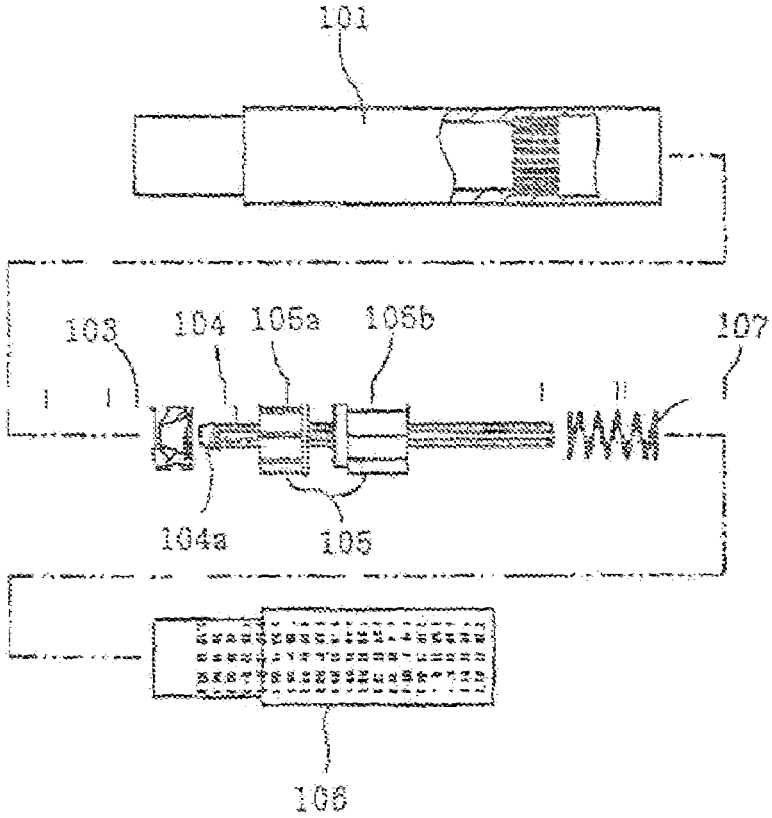
FIG. 7 PRIOR ART
FIG. 7 is a separated perspective view of a conventional ejecting type liquid cosmetics in prior art.

As shown in FIG. 2-FIG. 4, the construction of the cosmetics case includes a lower body 10 which forms a cylinder and stores the cosmetics liquid therein, an upper body 20 which is insertingly jointed on the upper portion of the lower body; a screw rod 30, having a piston 36 installed in the inside of said upper body 20 and lower body 10, coupled with a brush 50 and ejecting hole 40; and a cap 60 coupled on the upper portion of the upper body 20.

The lower body 10 has a cup configuration of which the lower portion is closed and opened on the top, and having a cylinder function for storing the cosmetics liquid 30 therein. An outward protruding ring 11 is formed on the upper outside peripheral surface of the lower body which freely rotates without separation of the upper body 20.

An inward ring 21, which is jointed with the outward protruding ring 11 of the lower body 10, is formed on the bottom inside peripheral surface of the upper body 20 and is joined with the lower body 10. A protruding portion 22, is formed on an upper portion adjacent to the inward ring 21, which is fixed by being inserted in a groove 34*a* which is formed on the periphery of a screw fitting plate 34. An opening portion 23 is formed on the upper portion, as herein after described.

A brush 50 is fixed on the upper portion of a brush plate 51 on the top of the ejecting hole 40 in the inside of upper body 20 and installed through the opening 23.

A liquid transfer tube 41 is formed on an upper portion of the supporting plate 42, which is formed as a disk, and an insertion portion 43 is formed on the lower portion on the ejecting hole 40.

A screw rod 30 is insertingly jointed to the bottom of the ejecting hole 40, an upper inside hole 31 is formed in a projection on the top of the screw rod 30, a through hole 32 and a perpendicular hole 33 are formed on the bottom of the inside hole 31.

Connected to the inside of the screw rod 30, a screw fitting plate 34 is formed outside the periphery of an upper suitable position of said screw rod 30, and integrated therewith. A piston 36 is fitted with nuts on the periphery of the lower screw rod 30 and is thus, positioned on the bottom of the screw fitting plate 34.

An o-ring 36*a* is insertingly fitted on the inside of lower portion of the piston 36 to maintain a closed tightness by a nut fitting on the screw rod 30.

The spring 31*b* and the check valve 31*a* are insertingly fitted on the inside of the inside hole 31 formed on the top of the screw rod 30 and prevent a flow of cosmetics liquid 3 when not in use and the top end of the screw rod 30 which forms the upper inside hole 31, is insertingly jointed to the insertion part 43 which is formed on the bottom of the ejecting hole 40.

The lower body 10 is insertingly jointed to the bottom of the upper body 20 to contain the brush 50, the ejecting hole 40 and the screw rod 30. The piston 36, which has a nut jointed to the periphery of the screw rod 30 is insertingly coupled with a strong tightness to the inside of the lower body 10.

Now, the action of the present invention in use in a preferred embodiment of the present invention will be described.

The present invention is assembled initially as in FIG. 3. A suitable quantity of cosmetics liquid 3 are filled in the lower body 10. The brush 50, ejecting hole 40 and the screw rod 30 are inserted to the inward ring 21 of the upper body 20 and coupled to the outwardly protruding ring 11 formed on the lower body 10. Thus, lower body 10 and the upper body 20 are integrally jointed and about to rotate integrally. Furthermore, the piston 36 is insertingly jointed to the bottom of the screw rod 30. The screw fitting plate 34 which is formed on a suitable position of the upper portion of the screw rod 30, is fixed to a protruding portion 22 of the upper body 20 by the insertion of the groove 34*a*. Thus, the position is fixed to suppress rotation.

Then, when using the cosmetics liquid, the user opens the cap 60 and takes hold the upper body 20 with one hand and holds lower body 10 with another hand. By turning in one direction, the piston 36 is rotated with the lower body 10, so that the piston 36 moves upwardly with the lower body 10 along the line of the screw on the screw rod 30. That is, the inside of the piston 36 is coupled with the screw rod 30, and the outside periphery is adjacent to the inside periphery of the lower body 10. Thus, when the lower body 10 is rotating along with the piston 36, the piston 36 moves along with the line of screw of the screw rod 30.

Since, the downward direction movement of the piston 36 causes the pressure of the inside of the lower body 10 which is filled with the cosmetics liquid 3, to increase, the check valve 31*a* is pushed against the spring 31*b* which is installed on the upper inside hole 31 of the screw rod 30. Concurrently with thus, the through hole 32 is opened and the cosmetics liquid 3 in the inside of the lower body 10 passes through the perpendicular hole 33, through hole 32 and upper inside hole 31 and is ejected to the brush 50 which is insertingly fixed on the upper portion of liquid transfer tube 41.

Therefore, the user can use the cosmetics liquid 3 that is ejected from the inside of lower body 10 by the degree of rotation of the lower body 10 on the side of the brush 50.

When, the user stops the revolution of the lower body 10 after ejecting the cosmetics liquids 3 on the brush 50, the pressure inside of the lower body 10 is reduced and the check valve 31*a* is returned by the spring 31*b* which installed in the upper inside hole 31 of the screw rod 30. The through hole 32 is closed and thus, prevents the ejection of cosmetics liquid 3.

The cosmetics case according to the present invention ejects the cosmetics liquid 3 only with the revolution of the lower body 10 and therefore, never ejects when the turning is stopped.

When, the user turns the lower body 10 too far and too much quantity of the cosmetics liquid 3 are ejected, the piston 36, which is jointed to the screw rod 30, may turn in the reverse direction to evacuate the inner portion of the inside of the lower body 10, by the returning of the lower body 10 in the reverse direction, so that the check valve 31*a* is drawn back to close the through hole 32, thus preventing the ejection of the cosmetics liquid 3.

As described above, according to the present invention, it is possible to use the present invention for opening and closing for a suitable quantity of the cosmetics liquid 3 and to prevent the loss by ejecting by the check valve 31*a* from the change of the temperature or inside pressure of the lower body 10 to expansion.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A cosmetics case comprising:

a lower body;

an upper body jointed to said lower body;

a cap removably jointed on an upper portion of the upper body;

a brush extending through an opening on the upper body so as to be exposed when the cap is removed;

an ejecting hole including a supporting plate, an insertion portion connected to a bottom of the supporting plate and a liquid transfer tube connected to an upper portion of the supporting plate, the liquid transfer tube being in communication with the insertion portion, the liquid transfer tube extending into the brush;

a screw fitting plate;

a screw rod connected to a bottom of the screw fitting plate, said screw rod having threads formed on an outer surface thereof, and being hollow, said screw fitting plate, having a projection extending upwardly from said screw rod and being in communication with the hollow inside of the screw rod;

an upper inside hole being formed at a top of the projection of the screw fitting plate which is jointed to a bottom of the ejecting hole;

a spring and check valve being received inside the inside hole to control flow there through;

a piston having an inside thread mounted about the threads of said screw rod;

said ejecting hole, screw fitting plate, screw rod and piston being received inside said upper body;

said lower body being filled with a cosmetic;

wherein rotation of said lower body in relation to said upper body causes said piston to move downwardly, pressing the cosmetics which is caused to flow through the hollow of the screw rod, the screw fitting plate, the projection, the upper inside hole, the check valve, the insertion portion and the liquid transfer tube so to as to be ejected into the brush.

* * * * *